US007131223B2

(12) United States Patent
Krotts et al.

(10) Patent No.: US 7,131,223 B2
(45) Date of Patent: Nov. 7, 2006

(54) PORTABLE IRONING PAD ASSEMBLY

(75) Inventors: Dean B. Krotts, Milwaukee, WI (US); Michael S. Kellogg, Oconomowoc, WI (US)

(73) Assignee: Bajer Design & Marketing, Inc., Waukesha, WI (US)

( * ) Notice: Subject to any disclaimer, the term of this patent is extended or adjusted under 35 U.S.C. 154(b) by 0 days.

(21) Appl. No.: 11/086,862

(22) Filed: Mar. 22, 2005

(65) Prior Publication Data

US 2006/0213093 A1 Sep. 28, 2006

(51) Int. Cl.
*D06F 83/00* (2006.01)
*D06F 81/00* (2006.01)

(52) U.S. Cl. ..... 38/140

(58) Field of Classification Search ..... 38/137, 38/138, 139, 140, 66; 428/34.1, 36.1, 73, 428/116, 118, 121, 304.4, 308.8; 264/171.26, 264/177.12; 156/89.22; 2/455
See application file for complete search history.

(56) References Cited

U.S. PATENT DOCUMENTS

| | | | | |
|---|---|---|---|---|
| 211,461 | A | 1/1879 | Deming | |
| 1,266,993 | A | 5/1918 | Romans | |
| 1,339,831 | A | 5/1920 | Locke | |
| 1,796,714 | A | 3/1931 | James | |
| 1,832,545 | A | 11/1931 | Grant | |
| 1,844,128 | A | 2/1932 | La Chapelle | |
| 1,870,934 | A * | 8/1932 | Strobridge | 38/66 |
| 1,891,179 | A | 12/1932 | Pruden | |
| 1,895,731 | A * | 1/1933 | Prenzel | 38/140 |
| 1,947,613 | A | 2/1934 | Northup | |
| 2,011,130 | A | 8/1935 | Ward | |
| 2,026,961 | A | 1/1936 | Brodt | |
| 2,133,175 | A | 10/1938 | Nicholson | |
| 2,210,601 | A | 8/1940 | Scanlon | |
| 2,234,143 | A | 3/1941 | Johannsen | |
| 2,249,110 | A | 7/1941 | Browning | |
| 2,269,804 | A | 1/1942 | Allaback | |
| 2,274,703 | A | 3/1942 | John | |
| 2,282,300 | A | 5/1942 | Place | |
| 2,326,062 | A | 8/1943 | Parker | |
| 2,335,494 | A | 11/1943 | Fay et al. | |
| 2,418,969 | A | 4/1947 | Di Gesare | |
| 2,432,932 | A | 12/1947 | Peters | |
| 2,644,257 | A | 7/1953 | Emmett et al. | |
| 2,652,646 | A | 9/1953 | Cave, Jr. | |
| 2,907,127 | A * | 10/1959 | Waugh et al. | 38/137 |
| 3,483,954 | A | 12/1969 | Michalski | |

(Continued)

FOREIGN PATENT DOCUMENTS

| | | |
|---|---|---|
| BE | 547805 | 5/1956 |

(Continued)

*Primary Examiner*—Ismael Izaguirre
(74) *Attorney, Agent, or Firm*—Ryan Kromholz & Manion, S.C.

(57) ABSTRACT

An ironing pad having a relatively flexible laminate structure including among its layers an integrally formed, independent layer supporting hollow core units which are disposed adjacent to one another and being received in an individual pocket formed in overlying layers of a closed-sided envelope, and in which hollow core is formed of a plurality of contiguous adjacent open-cell cavities which provide a heat barrier in addition to a layer of relatively high-compressive strength for supporting the weight of steam or flat iron pressing of fabric materials. The pad assembly may include three separate hollow core heat barrier units in hinged relationship with one another to provide a relatively shortened lengthwise dimension to the entire assembly when the end units are folded.

9 Claims, 3 Drawing Sheets

U.S. PATENT DOCUMENTS

| | | | | | |
|---|---|---|---|---|---|
| 4,043,062 | A | | 8/1977 | Lehrman | |
| 4,360,984 | A | | 11/1982 | Ruttenberg | |
| 4,557,062 | A | | 12/1985 | Mattesky | |
| 4,565,021 | A | | 1/1986 | Kay et al. | |
| 4,599,988 | A | | 7/1986 | Madurski | |
| 4,621,003 | A | | 11/1986 | O'Kane | |
| 4,813,166 | A | | 3/1989 | Drake | |
| 4,903,421 | A | * | 2/1990 | Saito | 38/137 |
| 4,982,516 | A | | 1/1991 | Cervantes | |
| 5,161,319 | A | | 11/1992 | Boyd | |
| 5,231,777 | A | | 8/1993 | Mattesky et al. | |
| RE34,450 | E | | 11/1993 | Saito | |
| 5,371,961 | A | | 12/1994 | Mattesky | |
| 5,392,543 | A | | 2/1995 | Lehrman | |
| 5,497,570 | A | | 3/1996 | Burshaw et al. | |
| 5,701,621 | A | * | 12/1997 | Landi et al. | 5/691 |
| 5,830,548 | A | * | 11/1998 | Andersen et al. | 428/36.4 |
| 5,894,690 | A | * | 4/1999 | Lehrman | 38/140 |
| 5,918,309 | A | * | 7/1999 | Bachner, Jr. | 2/2.5 |
| D427,402 | S | | 6/2000 | Kellogg et al. | |
| 6,212,801 | B1 | | 4/2001 | Kellogg et al. | |
| 6,336,220 | B1 | * | 1/2002 | Sacks et al. | 2/22 |
| 6,349,490 | B1 | * | 2/2002 | Gross et al. | 38/140 |
| 6,497,057 | B1 | * | 12/2002 | Lee et al. | 36/35 R |
| 6,793,991 | B1 | | 9/2004 | Thuma et al. | |
| 6,834,450 | B1 | * | 12/2004 | Gross et al. | 38/137 |
| 6,851,385 | B1 | * | 2/2005 | Poss et al. | 119/28.5 |

FOREIGN PATENT DOCUMENTS

| | | |
|---|---|---|
| GB | 746627 | 3/1956 |
| GB | 752473 | 7/1956 |

* cited by examiner

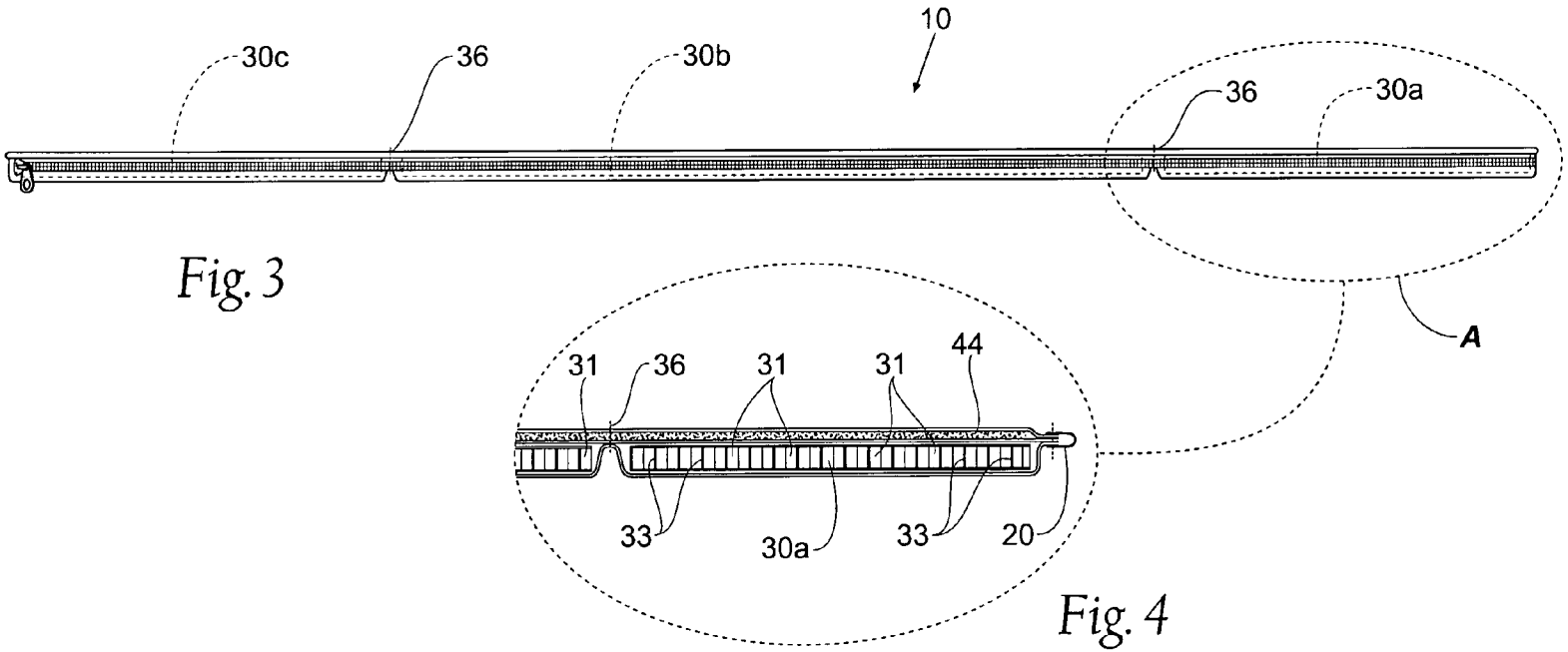
Fig. 3
Fig. 4
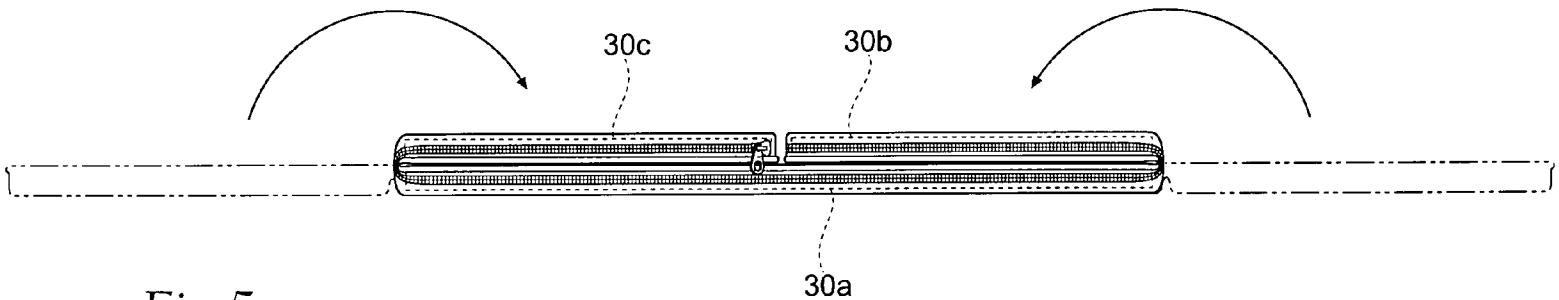
Fig. 5

PORTABLE IRONING PAD ASSEMBLY

BACKGROUND OF THE INVENTION

This invention relates to an ironing pad assembly, and more particularly to an ironing pad that may be made portable, and which is adapted to be used on top of a table or similar flat-topped furniture for ironing.

Recently, domestic ironing has been reduced as a household chore from as much as two full days per week to as little as a few hours per week. Thus, the less frequent use of conventional ironing boards, requiring setting up, folding of legs, and storage, has become a nuisance in view of the sporadic times in which ironing is done today. In this regard, there have been several attempts to provide portable pads to alleviate the nuisance of legged ironing boards, as well as providing means for assisting in portability by rolling the pad into a spiral for insertion into a pouch-like cover. These efforts were deficient in desired lateral support, which had, for the most part, been of flat wooden boards. The prior art also taught several efforts to provide portability to ironing pads with folding means to reduce size. By way of example, such means were disclosed in U.S. Pat. Nos. 2,326,062 and 5,161,319, respectively granted to Beatrice Parker and to Mary Boyd. Both patents suggested the use of conventional wooden boards (See symbolic cross hatching used in the presentation of FIG. 7 of Parker and see the Abstract of the Boyd patent discussing a "plywood ironing board" with additional "wood supports"), fastened to conventional hardware store hinges 12 in Parker and hinges 20*a* and 20*b* in Boyd. Obviously, those structures are relatively heavy and cumbersome to carry and to set up for accomplishing the ironing task.

SUMMARY OF THE INVENTION

The present invention provides an improved ironing pad of multi-layered construction having at least one layer comprising an integrally formed hollow core construction having a plurality of substantially contiguous, open-cell cavities sandwiched between oppositely disposed, parallel panels. Preferably, the cavities are configured to included sidewalls extending between and substantially perpendicular relative to the oppositely disposed panels. It will be apparent that such construction materially lessens the weight of conventional ironing boards formerly utilizing solid wood construction. The compressive strength of open-cell, hollow core construction has been found to be substantially equivalent to solid construction.

Further, it is an additional object of this invention to provide a portable, multi-layered ironing pad assembly, which may include the aforementioned supporting layer of hollow core construction, or for that matter, a supporting layer of one or more longitudinally spaced, relatively thin, solid board or plywood construction. Such ironing pad assembly includes a longitudinally foldable sheet which, when folded, defines a close-sided envelope capable of being proportionally divided by transverse sewing stitches to provide adjacent pockets for receiving individual longitudinally adjacent, integrally formed, single panel units or supporting layers of open-core construction. The stitching together of overlying layers of the envelope layer also provides a satisfactory and convenient hinging means for folding the adjacent board or panels together. The folded sections also permit considerable reduction in pad length for convenience in transporting and storage.

BRIEF DESCRIPTION OF THE DRAWINGS

FIG. 3 is a longitudinal side view of the ironing pad of FIG. 1, and with its zippered closure member being shown in closed position.

FIG. 4 is an enlarged, fragmental, longitudinal side view of an end pocket portion of the ironing pad of this invention, and defined by an elliptically outlined area A FIG. 5 is a longitudinal side view, similar to the view of FIG. 3, but with oppositely disposed pocket portions being shown in folded upwardly and inwardly to reduce the length of the pad and enhance its portability.

DESCRIPTION OF THE PREFERRED EMBODIMENTS

Figure 1:
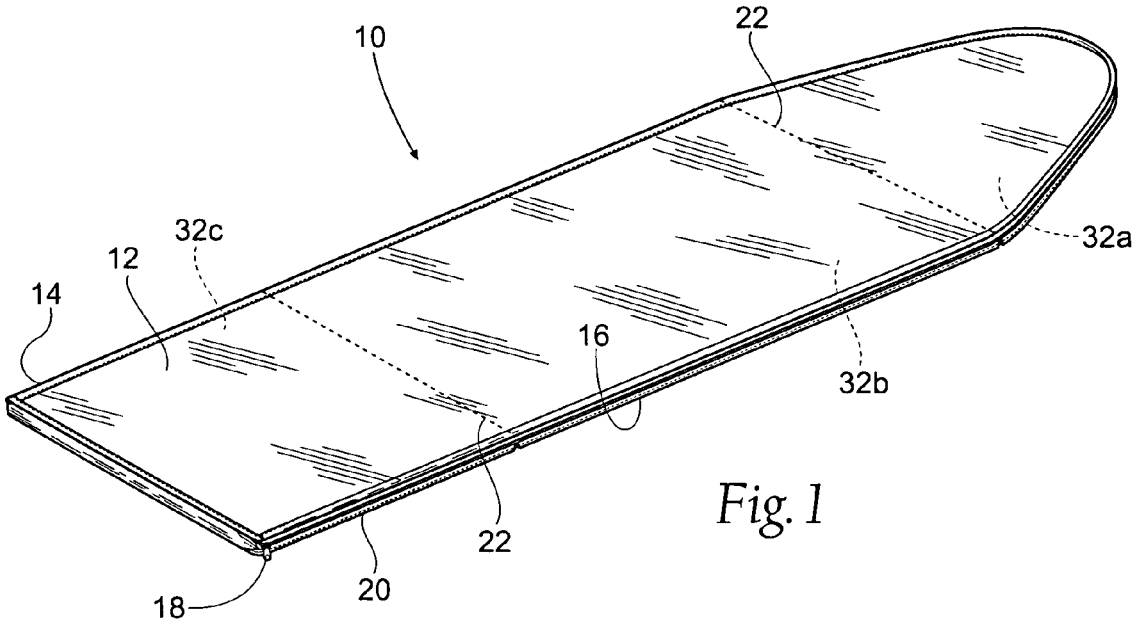
FIG. 1 is a perspective view of an ironing pad in accordance with the invention, and being shown in unfolded position, ready to being placed on a table or other supporting flat surface.

Referring to the drawings, wherein like reference numerals indicate like or corresponding parts, and referring particularly to FIG. 1, there is shown an ironing pad assembly 10 which may be of portable construction, and which may be supported by a table or similar furniture having a flat supporting surface. It will be obvious that pads of this type should be capable of being folded, or otherwise capable of being of reduced in length and to be of lightweight construction.

The ironing pad assembly 10 made in accordance with the present invention, is preferably multi-layered, and includes a cover layer 12 of conventional heat-resistant fabric material that extends around the top of the pad assembly 10, the side 14 and the under layer 16. The various layers of the laminated pad assembly 10 may be conveniently enclosed by means of an elongated zipper unit 18. The zipper unit 18 need only extend around the periphery of the pad assembly 10 to provide access to the open-ended, hinged, pocket portions to be hereinafter described. The upper and lower marginal edges of the pad assembly 10 are preferably joined, sewn together, and covered by a sewn-on welting fabric strip 20. The pad assembly 10 is preferably constructed to be folded along the dotted lines 22.

Figure 2:
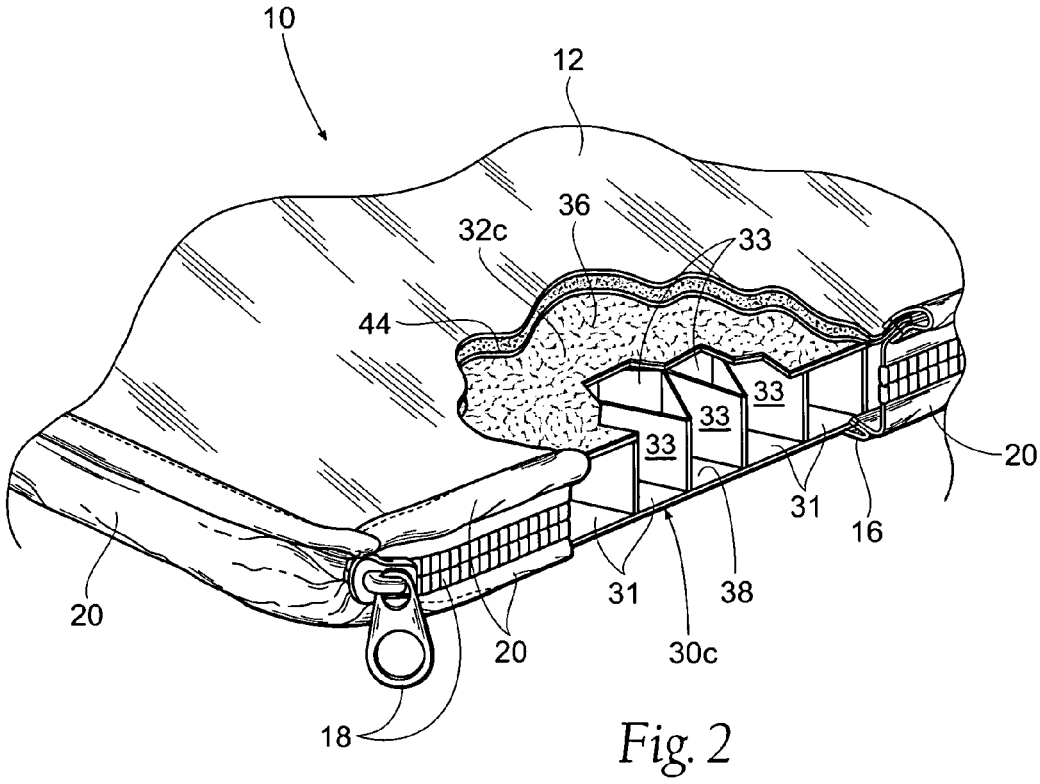
FIG. 2 is a perspective view of a selected area broken way from the peripheral facing marginal edge of the pad of FIG. 1 and showing, in detail, a preferred arrangement of supporting hollow core construction used in forming a supporting layer of the pad.

With particular reference to FIG. 2, it will be noted that a lightweight, supporting layer 30 is preferably provided, especially when the pad assembly 10 is of the portable type. The layer 30 is preferably comprised of laterally adjacent integrally formed, individual supporting open-cell units, details of which are shown in the views of FIGS. 2–5, inclusive, and respectively designated 30*a*, 30*b* and 30*c*. The individual hollow core units 30*a*, 30*b* and 30*c* are integrally formed of lightweight, pressed paperboard having a series of open-cells 31 (see FIG. 2) including upstanding side walls 33. The sidewalls 33 are substantially perpendicular to and extend between parallel, oppositely disposed, relatively flat, upper and lower panel units 36 and 38. This construction was found to be comparatively lightweight and relatively strong for its size. A very simple compression strength test indicated that a young man of approximately 225 pounds, and wearing flat-healed shoes, was able to stand on a sample piece of ½ inch paper pressboard, as described herein, without any damage to the surface to the panel, even when the panel was covered with a layer of relatively thin, heat reflective, aluminum foil 37 (approximately 2 mils.). As disclosed in the enlarged detail view of FIGS. 3 and 4, integrally formed, adjacent supporting hollow core units 30*a* and 30*c*, respectively reside in end pocket portions 34*a* and 34*c* and an elongated intermediate pocket 34*b* disposed adjacent to and between end pockets 34*a* and 34*c*. The elongated, intermediate hollow core unit 32*b* completes the lateral support for ironing pressure exerted on the cover layer 12 of the pad assembly 10. The releasable zipper unit 18 provides access for entry of the respective hollow core units 32*a*, 32*b* and 32*c* in their respective pocket portions 34*a*, 34*b* and 34*c*. The adjacent pockets 34*a*–34*b* and 34*b*–34*c* are formed by transverse stitching 36 (See FIG. 4). The transverse stitching 36 provides the additional function of becoming a hinge for supporting and folding of adjacent units 30*a*–30*b* and 30*b*–30*c*. The stitching 36 sewn at fold lines 22 (See FIG. 1), conveniently provides the means for folding the pad assembly 10 lengthwise to reduce its overall length, and also to eliminate need for heavy, cumbersome, hardware hinges screwed into relative heavy, cumbersome, wood or plywood support members of prior art devices.

A preferred construction of individual hollow core units 30*a*, 30*b* and 30*c*, as shown in the views of FIGS. 2 and 4, include adjacent, contiguous cavities, or cells 31 defined by adjoining side walls 33. In this preferred construction, each of the sidewalls 33 extend between the upper panel unit 36 and the lower panel unit 38. Each of the panel units 36 and 38 are relatively flat so that the subassembly of each of the units 30*a*, 30*b* and 30*c*, along with substantially perpendicular sidewalls 33, will provide a supporting layer of maximum cross-sectional strength. It is conceivable, however, where less strength is required, the open-cell units 30*a*, 30*b* and 30*c* may be comprised of hollow core cavities with defining walls not of particular orientation (not shown herein). It will also be apparent that any cavity configuration must be of sufficient dimension to provide low heat conduction characteristics. Such low heat conduction is required to withstand the relatively high ironing temperatures of modern flat irons and steam irons.

The construction of the supporting layer 30 (30*a*, 30*b* and 30*c*) may be, when desired, reduced in height to include a single panel unit 36. The individual panel units 36 and/or 38 may be selected from conventional panel board material. There are many available panel boards which provide adequate compressive strength, particularly for an ironing board pad such as the pad assembly described herein. Satisfactory individual supporting panel units 36 and/or 38 have been fabricated from conventional sheets having thicknesses ranging from $3/16^{th}$ inch to 1 inch.

Figure 6A:
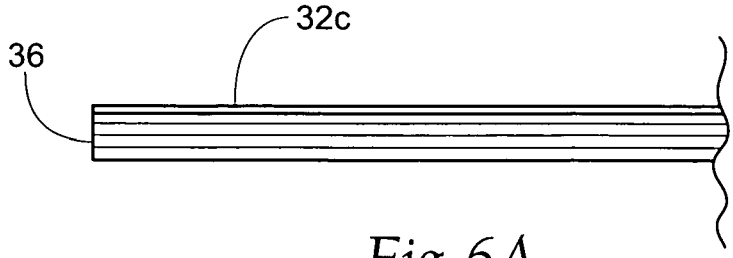
FIGS. 6A–6D, inclusive, are fragmented sectional views of individual, integrally formed, panel units which may be used individually or as a part of a hollow core supporting layer, and of selected size to reside in selected pockets of the preferred embodiment of the ironing pad described herein.

FIG. 6A is illustrative of a conventional plywood substrate with a reflective surface 32*c*.

Figure 6B:
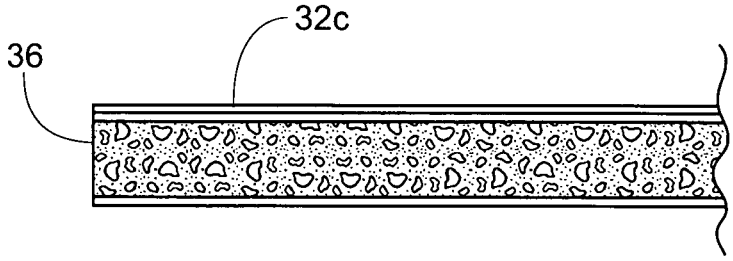

FIG. 6B exemplifies a solid substrate known as "GATORBOARD" multilayer composite or "FIREFLEX" multilayer composite with an exposed heat reflective surface 32*c*. A synthetic wood substrate with a heat reflective top surface 32*c* may also be selected from products known as "SYNPLY" cross band products, "GATORPLY" backer products or "LUXCELL" backer/facer products as well as conventional panel board made of multiple corrugated cardboard substrate or composite material with a heat reflective top layer 32*c*.

Figure 6C:
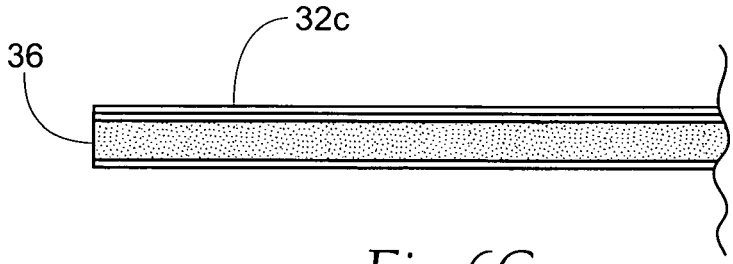
Figure 6D:
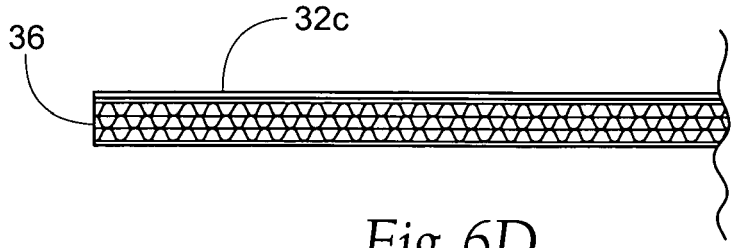

Some of these materials are flame resistant or may be treated to be flame resistant. All of them have high tensile and compressibility strength. Thicknesses may vary from $3/16^{th}$ inch to 1 inch thick. An example disclosed in FIGS. 6A, 6B and 6C, these would be considered rigid solid-core materials, whereas example shown in FIG. 6C would be semi- or rigid-open cell (hollow-core) materials. There are, of course, many plastics available on the market that may be used but must be selected where a relatively high temperature caused by the hot iron may be of concern.

For purposes of obtaining the above-mentioned materials, "GATORBOARD" multilayer composite is readily obtainable in thicknesses between $3/16^{th}$ inch and 1 inch from Art Grafix, a division of Stover Graphics of Beacon Falls, Conn., whereas "FIREFLEX" multilayer composite is a Melamine base obtainable from FireFlex Systems, Inc. of Boisbarand, Canada 37H 1N8. The three materials identified by the trademarks "SYNPLY" cross band products, "GATORPLY" backer products and "LUXCELL" backer/facer products are each obtainable from Uniwood, Alcan Composites of Statesville, N.C. The multiple corrugated cardboard substrate or composite material is readily available by consulting local business telephone directories through an Internet browser or other local paper suppliers.

Depending upon the desired construction of the ultimate manufacturer, there may be another layer 44 added to cushion pressure exerted on the cover layer 12 during ironing. Also, consumer demand may require a bottom layer (not shown) of non-slip rubber mesh material, such as made from polyethylene mesh.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

We claim:

1. An ironing pad assembly comprising:

a laminate structure including a top cover layer and a bottom cover layer;

an underlying envelope layer formed of a first and a second sheet of flexible fabric material;

said bottom cover layer and each of said first and second sheets of flexible fabric material being superposed adjacent one another and secured at least adjacent a first portion of the respective peripheral edges thereof;

a supporting layer comprising at least one relatively flat, integrally formed, supporting panel unit;

said envelope layer including at least one pocket portion configured to surround the periphery of said individually, integrally formed support panel unit.

2. The ironing pad assembly of claim 1, wherein the configuration of said pocket portion substantially conforms to the periphery of said supporting layer and is arranged to receive said supporting layer panel unit.

3. The ironing pad assembly of claim 2, including closure means for releasably securing the remaining portion of each of said respective peripheral edges and to provide reclosable access to the interior of said envelope layer.

4. The ironing pad assembly of claim 3, wherein the laminate structure includes a layer of reflective material adhering to the exposed surface of the uppermost panel of said parallel panels.

5. The portable ironing pad assembly of claim 4, wherein said envelope layer is divided into three inwardly foldable pocket portions;

said pocket portions including longitudinally spaced end pocket portions and an intermediate pocket portion, and wherein said intermediate pocket portion includes longitudinally spaced, transversely sewn stitches, said stitches providing hinged folding divider means between said intermediate pocket portion and the respective end portions.

6. A portable ironing pad assembly comprising:

a laminate structure including a pair of flexible fabric sheets;

said sheets being superposed adjacent one another and secured at least adjacent a first portion of the respective peripheral edges thereof to form one side of a longitudinally extending envelope layer;

said sheets being further secured together at laterally spaced intervals transversely of the longitudinal of said envelope layer to thereby provide a hinged, longitudinally foldable, pocket portion;

an integrally formed supporting layer, and said pocket portion including a securable peripheral portion adapted to receive said supporting layer.

7. The portable ironing pad assembly of claim 6, wherein the means for securing said sheets together at the first peripheral portion and said laterally spaced intervals comprises a series of sewn stitches.

8. The portable ironing pad of claim 6, wherein each of the open cell cavities is defined by sidewalls extending between said panels and being substantially perpendicular relative to said panels.

9. An ironing pad assembly comprising:

a flexible laminate structure;

said laminate structure comprising an integrally formed hollow core supporting layer and a pair of fabric sheets;

said supporting layer including at least one relatively flat, supporting panel and a plurality of substantially contiguous, open-cell cavities extending from the underside of said panel;

said hollow core supporting layer including oppositely disposed, relatively flat, parallel panels and a plurality of substantially contiguous, open-cell cavities sandwiched between said panels;

said fabric sheets being secured to form a pocket portion;

said pocket portion including a securable peripheral portion adapted to receive said integrally formed hollow core supporting layer.

* * * * *